United States Patent [19]

Wunder

[11] 4,059,882

[45] Nov. 29, 1977

[54] METHOD OF MAKING AN ANNULAR TUBE-FIN HEAT EXCHANGER

[75] Inventor: John E. Wunder, Dayton, Ohio

[73] Assignee: United Aircraft Products, Inc., Dayton, Ohio

[21] Appl. No.: 689,190

[22] Filed: May 24, 1976

[51] Int. Cl.[2] ..... B23P 15/26; B23P 17/00

[52] U.S. Cl. ..... 29/157.3 A; 29/157.3 B; 29/421 M; 228/183; 228/251

[58] Field of Search ..... 29/157.3 A, 157.3 B, 29/157.3 R, 421 M; 113/118 A, 118 B; 228/249, 251, 183, 243, 127

[56] References Cited

U.S. PATENT DOCUMENTS

| | | | |
|---|---|---|---|
| 1,984,115 | 12/1934 | Cooper | 29/157.3 R |
| 2,362,985 | 11/1944 | Brown, Jr. | 29/157.3 A |
| 2,693,026 | 11/1954 | Simpelaar | 29/157.3 A |
| 2,703,921 | 3/1955 | Brown, Jr. | 29/157.3 A |
| 2,882,587 | 4/1959 | Unger et al. | 228/243 |
| 3,158,122 | 11/1964 | DeGive | 29/157.3 A |
| 3,267,559 | 8/1966 | Laux | 29/157.3 A |
| 3,474,513 | 10/1969 | Allingham | 228/183 |
| 3,590,464 | 7/1971 | Wildi et al. | 29/421 M |
| 3,636,607 | 1/1972 | DeMarco | 29/157.3 R |

FOREIGN PATENT DOCUMENTS

| | | | |
|---|---|---|---|
| 667,029 | 2/1952 | United Kingdom | 228/249 |

*Primary Examiner*—C.W. Lanham
*Assistant Examiner*—Daniel C. Crane
*Attorney, Agent, or Firm*—J. E. Beringer

[57] ABSTRACT

A method of making a heat exchanger in which extended heat transfer material, such as a fin annulus composed of thin corrugated deformable metal, is installed in annular fluid flow paths defined between concentric tubes. Concepts of electromagnetic forming and metallurgical bonding are used in a unique combination of steps to arrive at a method well suited to economical production and which at the same time assures a high efficiency level of heat transfer and leak protection effects.

8 Claims, 11 Drawing Figures

METHOD OF MAKING AN ANNULAR TUBE-FIN HEAT EXCHANGER

BACKGROUND OF THE INVENTION

This invention relates to a method of making heat exchangers, and particularly to a method of making annular tube-fin heat exchangers.

The prior art known to me which is most pertinent to my invention is that represented by the disclosures in:

1. Brown Fintube Company, British Pat. No. 692,885, published June 17, 1953; and 2. Samuel J. DeMarco, U.S. Pat. No. 3,636,607, issued Jan. 25, 1972.

The disclosure of the British patent is pertinent because it is concerned with a heat exchanger comprised of concentric tubes and inserted "packing" material, tube surfaces and packing material being bonded together. The deficiencies of the British patent disclosure, insofar as the present invention is concerned, lie in a method of assembly which utilizes a preparation for bonding by tube expansion and which utilizes a technique for closing tube ends not involving the tube expansion step. The method of making of the British patent accordingly is inherently slow and not well suited to large scale production. The tube expansion process is, moreover, not one best calculated to achieve minimal contact resistance between the "packing" material and the tube wall. Gaps in continuing joints between the "packing" material and the tube walls produce non-uniform heat transfer effects. A closing of tube ends only as a part of the bonding step, and after tubes have been expanded, fails to take into account tolerance differences and variations in tube expansion which may occur, and as a result will normally involve after-fabrication sealing of gaps and crevices.

The disclosure of the United States patent is pertinent because it teaches a method of making a heat exchange tube in which an inserted fin annulus is compressed in a tube for low contact resistance by a process of electromagnetically deforming the tube radially inwardly. The deficiencies of the United States patent, insofar as its pertinence to the present invention is concerned, lie in a method of assembly which electromagnetically deforms a single tube radially inwardly toward a rigid central support but which does not teach that a tube assembly so formed may be used as the rigid central support in the deforming of another tube and that this may be used as the core of a still further tube and so on. Neither does the United States patent teach anything in regard to closing of the tube ends so that the several defined fluid flow paths may be used in effecting heat transfer between plural confined fluids. The United States patent deals with electromagnetic tube forming and is in no sense defective or incomplete in its disclosure. The concern of the present invention is with matters not taken up in the United States patent and which may be regarded as beyond the scope of the teachings of that patent.

SUMMARY OF THE INVENTION

The instant invention overcomes deficiencies of the prior art, in arriving at a method of making a heat exchanger which is both economically advantageous and productive of sound, highly efficient heat exchange devices.

According to the method, an annular tube-fin heat exchanger is made by bringing together tubes of different diameters, placing them in a nested concentric relation with a fin annulus installed between each adjacent pair of tubes, and closing the tube ends while providing fluid inlet and outlet openings to annular flow paths as occupied by the fin annuli. More particularly, the method has in view installing a first fin annulus of thin corrugated deformable metal in a first tube, providing a central rigid support for the first fin annulus, inserting annular closing members in the outer ends of the first tube so that inner and outer peripheries of each thereof are in approximately touching contact with the central support and the inner wall surface of the first tube respectively, applying a radially compressive electromagnetic force to the first tube to displace the tube wall radially inwardly to achieve an intimately contacting relation of the fin annulus and of inner and outer peripheries of the annular closing members with opposing tube and support surfaces, repeating the above sequence of operations with respect to successively larger diameter tubes in which the first tube becomes a rigid central support within a next larger tube and the next larger tube becomes a rigid central support for a still larger tube and so on, and subjecting a completed tube assembly to a brazing or like operation bonding tubes to intimately contacted fin annuli and to annular closing members. Prior to and during the bonding step, the completed tube assembly may be peripherally gripped and held to inhibit a return of the tubes from radially inwardly displaced conditions.

An object of the invention is to enable annular tube-fin heat exchangers to be made according to a method substantially as above defined.

Other objects and further particulars of the invention will more clearly appear from the following description, read in connection with the accompanying drawings, wherein.

Figure 1:
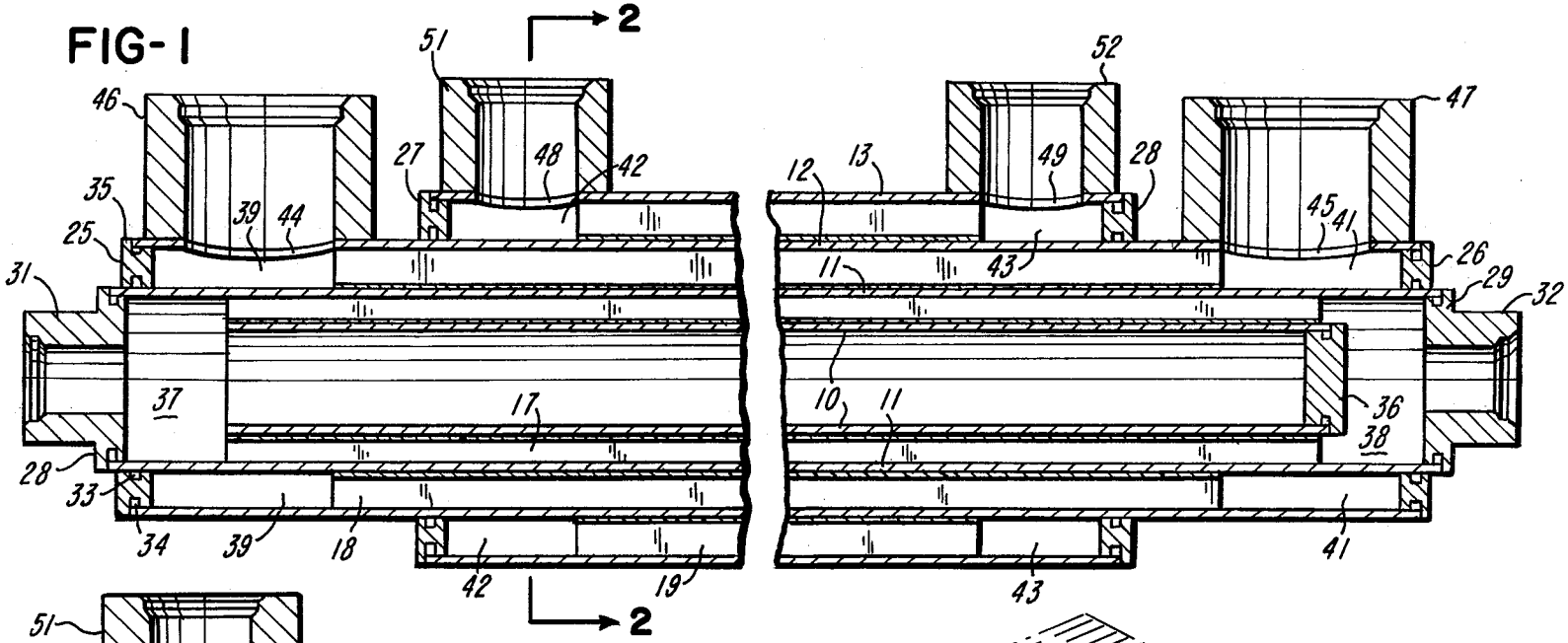
FIG. 1 is a view in longitudinal section of an annular tube-fin heat exchanger made according to the method of the invention.
Figure 3:
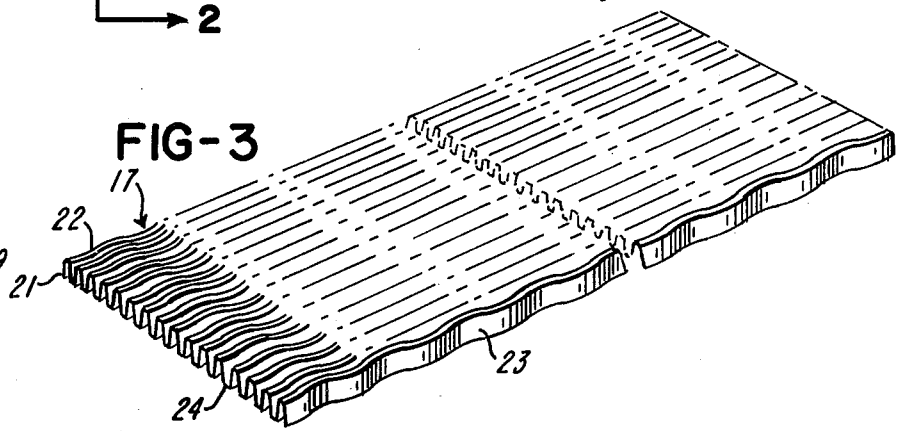
FIG. 3 is a detail view in perspective of a length of fin material useful in the invention method.
Figure 2:
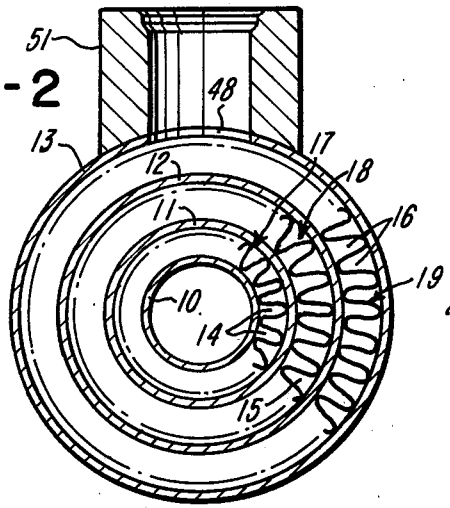
FIG. 2 is a view in cross section taken substantially along the line 2—2 of FIG. 1.

Referring to the drawings, a heat exchanger constructed according to an exemplary method of the invention may take a form as shown in FIGS. 1 and 2. The heat exchanger is essentially tubular in form and comprises a plurality of tubes 10, 11, 12 and 13. The tubes 10 to 13 have different diameters and occupy a nested relation to one another with the tube 10 of smallest diameter being received within tube 11 and with tube 11 being received within tube 12 and tube 12 being received within tube 13. By means and in a manner which will hereinafter more clearly appear, the tubes 10-13 are held in a concentric spaced apart relation with one another. The result is to provide between the tubes 10 and 11 an annular space 14, between the tubes 11 and 12 an annular space 15 and between the tubes 12 and 13 an annular space 16. Each space 14, 15 and 16 serves as a longitudinal flow path for a fluid put through the heat exchanger to be in heat transfer relation to another fluid therein and the several flow paths are occupied respectively by fin annuli 17, 18 and 19. A segment of the fin annulus 17 is shown in FIG. 3. It is there seen to be comprised of a thin deformable metal of good heat conductivity. Originally in sheet form, it is gathered and crimped to a corrugated formation to define a series of parallel fins 21 of longitudinal extent. Each fin comprises a peak portion 22 connected by generally vertically orienting side walls 23 to valley portions 24. While the fin material may take various forms, it is in the illustrated instance shown to have a ruffuled configuration. The fin annuli 18 and 19 are or may be the same as annulus 17. In each instance, the sheet of crimped and corrugated fin material is bent around a longitudinally extending mid point thereof and side edges brought into a substantially contacting relation. In the circular or annular form so defined, the fin annulus is installed in respective spaces 14, 15 and 16 between the tubes. A principal purpose of the fin annulus is to act as an extended surface heat transfer means improving the conduct of heat to or from a fluid flowing in a space 14, 15 or 16 and adjacent tube walls. It is in this connection to be desired that peak and valley portions of individual fins 21 make a close intimate contact with respective tube walls in a manner to provide minimal opportunity for contact resistance, that is, resistance to a flow of heat energy at the tube wall.

The interposing fin annuli 17, 18 and 19 play a part in establishing and maintaining the tubes 10, 11, 12 and 13 in a concentric spaced relation. Also serving a purpose in this connection are ring members 25–26 positioning between tubes 11 and 12 and ring members 27–28 positioning between tubes 12 and 13. In addition, there is positioned within opposite ends of the tube 11 ring members 28 and 29, central portions of which project as tubular fittings 31 and 32 respectively. The several ring members act as closures in the respective tubes in which they position, and, since they are all basically the same in construction, a description of one will suffice for all. Thus, ring member 25 has concentric inner and outer peripheries in which are respective grooves 33 and 34, serving a purpose, as will hereinafter more clearly appear, in containing brazing wire or the like. At a front marginal edge of the ring member is a low flange or lip 35 adapted to abut a tube end and limit insertion of the ring member therein. Acting as closure for one end of the tube 10 is a plug 36 which at its periphery is structured like peripheral portions of the ring members and interacts in a like manner with its respective tube end.

The fin annulus 17 is approximately co-extensive in length with the tube 10. The latter is shorter in length than tube 11 and is centered between the ends thereof so that there is defined between the tube 10 and respective ring members 28 and 29 enclosed chambers 37 and 38. Tube 12 is about the same as or a little less than the tube 11 in length and fin annulus 18 is shorter than the tubes between which it positions. This produces annular chambers 39 and 41 inwardly of respective ring members 25 and 26. Tube 13 is substantially shorter in length than tube 12 and fin annulus 19 therein cooperates with ring members 27 and 28 in defining annular chambers 42 and 43. Tube 12 near its opposite ends has lateral openings 44 and 45 communicating with respective chambers 39 and 41. Fixed to the tube surface over opening 44 and 45 are respective fittings 46 and 47. In similar fashion, tube 13 has end positioning apertures 48 and 49 capped by respective fittings 51 and 52, the apertures opening into respective chambers 42 and 43.

The device of the drawings is constructed for a segregated flow of three confined fluids, flow occurring longitudinally of the device in flow paths as defined by annular spaces 14, 15 and 16. A first fluid, entering the device by way of fitting 31, for example, collects in chamber 37, flows longitudinally along the corrugations of fin annulus 17 and into chamber 38 where it discharges by way of fitting 32. A second fluid, entering the device by way of fitting 47 and aperture 45 for example, collects in chamber 41, flows longitudinally along the corrugations of fin annulus 18 and into chamber 39 where it discharges by way of opening 44 and fitting 46. A third fluid, entering the device by way of fitting 51 and opening 48, for example, collects in chamber 42, flows longitudinally along the corrugations of fin annulus 19 and into chamber 43 where it discharges by way of opening 49 and fitting 52. Heat transfer in a combination of conduction and convection effects occurs, particularly as between the second fluid flowing in space 15 and the first and third fluids flowing in spaces 14 and 16. Various uses of the heat exchanger structure are possible, as for example the use of a second fluid flowing in space 15 to cool or to heat first and third fluids flowing in spaces 14 and 16. Heat transfer takes place through the tube walls and is substantially aided by the fin annuli 17–19 providing in effect extended heat transfer surface.

In constructing the heat exchanger of the drawings, parts substantially as illustrated are fabricated and brought together. In the case of ring members 25–29 and of plug 36, peripheral grooves therein are filled or substantially filled with a brazing wire 50, that is, a wire or wire-like filament comprised of a braze alloy. Also in the preliminary fabrication, the sheet material of which the fin annuli 17–19 is formed is clad on both sides, that is, both top and bottom, with a braze alloy 53 (see FIG. 7). This assures that in the crimped or corrugated condition of the sheet material, both peak portions 22 and valley portions 24 are coated or clad with a braze material, the braze material being an alloy which in the brazing process melts and flows at a temperature beneath the melting point of parent materials with which the braze alloy is in contact.

Figure 5:
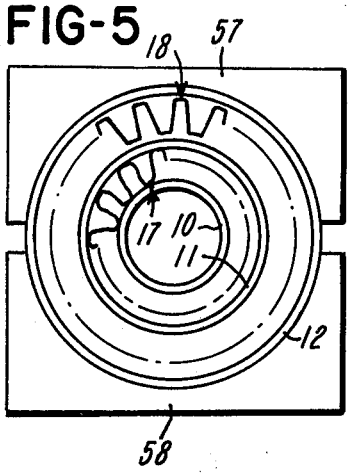
FIG. 5 is a view like FIG. 4, showing a second stage of assembly.
Figure 6:
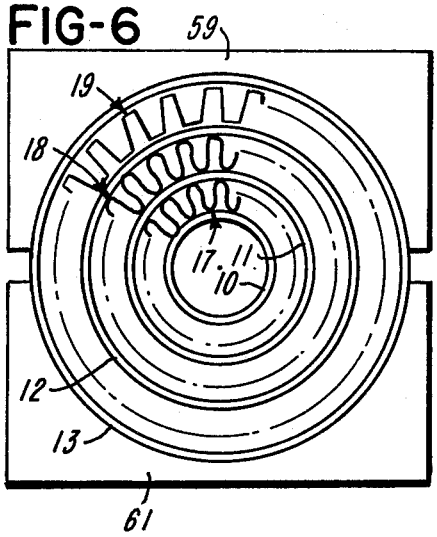
FIG. 6 is a view like FIGS. 4 and 5, showing a third stage of assembly.
Figure 7:
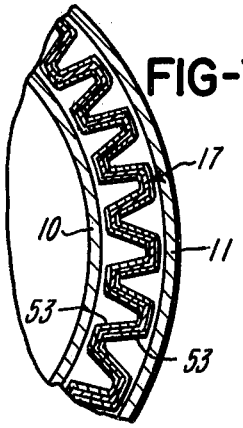
FIG. 7 is a detail view, enlarged with respect to the preceding views, showing a segment of a fin annulus installed between a tube and rigid central support substantially as the parts appear before electromagnetic forming.
Figure 8:
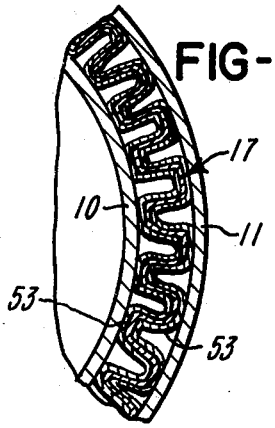
FIG. 8 is a view like FIG. 7, showing the parts as they appear after electromagnetic forming but before brazing.
Figure 9:
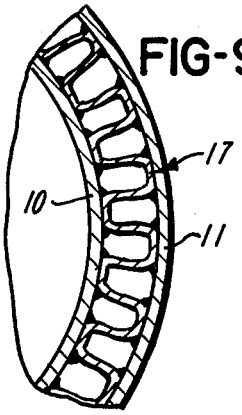
FIG. 9 is a view like FIGS. 7 and 8, showing the parts as they appear after brazing.
Figure 10:
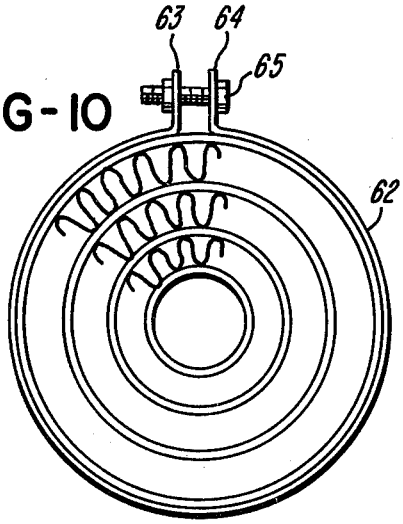
FIG. 10 is a view, reduced relative to other views, showing an assembled heat exchanger confined and held for brazing.
Figure 11:
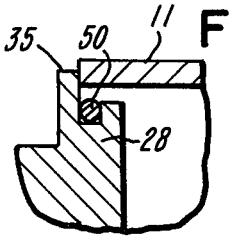
FIG. 11 is a fragmentary detail view, showing a tube and ring member as they appear in an assembled relation but prior to electromagnetic forming.

In a first assembly step, a plug 36 is inserted in one end of the tube 10. The tube 10 is then wrapped with one or more lengths of corrugated fin material whereby to form the fin annulus 17. The sub-assembly so formed is then inserted in the tube 11 and centrally positioned therein substantially as illustrated. The dimensions of the parts are such that the fin annulus 17 is received relatively loosely in space 14, the relationship of the parts being substantially as illustrated in FIG. 7. A relatively wide spacing exists at this time between tubes 10 and 11, facilitating insertion of the sub-assembly comprising parts 10, 36 and 17. Fittings 31 and 32 are installed in opposite ends of the tube 11, the reception of peripheral portions of the fittings being limited by abutment of the lip 35 with the tube end. As indicated in FIG. 11, ring member 28 is at this time relatively loosely received in the tube 11 with the inside diameter of the tube slightly exceeding the outside diameter of the ring member. The tube 11 and contained parts then is inserted in an electromagnetic forming coil diagrammatically illustrated in FIGS. 4, 5 and 6 hereof as being comprised of opposing, complementary coil portions 54 and 55. This is a device storing and releasing electrical energy which assumes the form of magnetic pressure with respect to a work piece. In this instance, the forming coil has a generally cylindrical shape and is suitably connected to a power source to draw energy for a period of seconds, store it and then release the energy in a fraction of a second to do work at a high-energy rate. The coil is constructed to have a length exceeding that of tube 11 so that a fully inserted tube is completely contained within the coil which overlaps the ends thereof. Approximately centered within the coil, the tube is completely and uniformly subject to the magnetic field exerted by the discharging coil. Adapter means 56 is positioned between the jaws 54 and 55, or constructed to be a part thereof, to receive and position a tube within the coil. In the process, electrically conductive tube 11 becomes a work piece. It is subjected, in response to release of the stored electrical energy, to a force proportional to the intensity of the magnetic field and current. The generated force results in a movement of the conductor, in this instance the tube 11. The coil, since it substantially completely surrounds the tube 11, applies a force directed radially inwardly so that the material of the tube 11 is displaced in this direction resulting in a reduction in tube diameter. Since the tube is completely surrounded by the windings of the coil, all parts of the tube are independently and equally responsive to the inwardly directed pressure. However, while the tube is uniformly affected by the electrical discharge it is free to conform to the underlying surface or surfaces against which it is pressed. The contracting tube encounters a firm resistance in the form of ring members 28 and 29 but intermediate its ends encounters relatively compressible means in the form of the fin annulus 17. At its ends, therefore, the tube 11 closes tightly upon the ring members 28 and 29 and intermediate its ends engages and applies a compressive pressure to the fin annulus 17, squeezing it between the inner surface of outer wall 11 and the outer surface of inner tube 10. Peaks 22 and valleys 24 of the individual fins 21 are compelled to a broadened contact with respectively contacted surfaces and intermediately interconnecting wall portions 23 are caused slightly to buckle under the applied forces of compression. The parts at this time assume a position substantially as illustrated in FIG. 8. The contracting tube is free, moreover, to conform to irregularities in the fin surface and is effective to apply a substantially uniform compression to the entire fin annulus. The fin annulus is accordingly subjected over its entire area to a firm, pressural contact with at least the inner wall surface of tube 11, assuring a low, uniform level of contact resistance.

Figure 4:
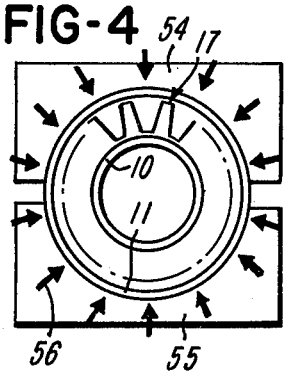
FIG. 4 is a detail view, partly diagrammatic, of a first stage of assembly, the parts being shown as they position prior to electromagnetic forming.

The details of means for energizing the electromagnetic forming coil are not shown as being unessential to an understanding of the method of the invention. They may include a suitable charging circuit, switching and capacitor means. Arrows 56 in FIG. 4 illustrate how current discharging from the coil is directed as an inwardly forming pulse upon the tube 11.

Following the electromagnetic forming step, the sub-assembly comprising tubes 10 and 11, fin annulus 17 and fittings 31 and 32 is in unitary form and is withdrawn from the electromagnetic coil diagrammatically represented by the opposing jaws 54 and 55. Tube 11 then is wrapped by a fin annulus 18 and inserted in tube 12. Opposite ends of the tube 12 are closed by inserted ring members 25 and 26. The fin annulus 18 and the ring members 25 and 26 are at this time relatively loosely received in the tube 12, substantially in a manner as has been illustrated in connection with fin annulus 17 and ring members 28–29 in FIGS. 7 and 11. The ring members 25–26, however, have an inner diameter dimensioned to agree substantially with the outside diameter of tube 11 as it has been altered by the step of FIG. 4. This assembly of parts is inserted in a second electromagnetic forming coil which has been diagrammatically represented in FIG. 5 hereof as comprising opposing jaws 57 and 58. In a manner which has been discussed in connection with the step of FIG. 4, an electromagnetic energizing pulse is developed between the jaws 57-58 as a consequence of which tube 12 is reduced in diameter. Ends thereof reach an intimately contacting relation to the ring members 25–26 and between its ends the tube accomplishes an intimately contacting relation to peaks of the fin annulus 18. At the same time, the valley portions of the fin annulus 18 are caused to seat firmly to the tube 11. The generated pulse of the electromagnetic forming coil, it will be understood, is selected to have a deforming effect upon tube 12 but to be substantially without effect on interiorly positioning tubes 11 and 10. Tube 11 accordingly acts as a rigid central support upon which the fin annulus 18 may be compressed, in the same manner that tube 10 acts as a central rigid support upon which fin annulus 17 may be compressed.

In a still further forming step, the assembly comprising tubes 10, 11 and 12 and associated parts is withdrawn from the forming jaws 57–58 and wrapped by the fin annulus 19 with the further assembly so defined being inserted in tube 13. The tube 13 is positioned centrally of the tube 12 and ring members 27 and 28 are inserted in a relationship of parts substantially the same as that described in connection with ring members 25-26 and tube 12. This assembly is placed in a third electromagnetic forming coil diagrammatically represented in FIG. 6 by opposing jaws 59 and 61. A generated forming pulse has the effect, as described before, of reducing the diameter of tube 13, causing ends thereof to seat firmly to the ring members 27–28 and causing portions of the tube intermediately of its ends to achieve an intimately contacting, compressive relationship to the individual fins 21 of the fin annulus 19. Valley portions of the fin annulus 19 react against tube 12, which thus serves as a central longitudinal support and the fins 21 are allowed to buckle or deform substantially as has been before described.

Steps as set out above may be continued to define additional flow passages. In the illustrated instance, however, the assembly comprising the several tubes 10–13 with installed fin annuli and inserted ring devices is subjected to a brazing operation. In this process, which may advantageously be carried out in a furnace or by any of other known brazing methods, the electromagnetically formed assembly is subjected to a rising temperature, the highest temperature value reached being sufficient to melt the braze alloy which appears as a cladding on the fin annuli and as inserted braze wire 50 in ring member grooves 33–34 but insufficient to melt the parent material of other components of the assembly. The flowing braze alloy intimately contacts adjacent tube surfaces, and, upon a lowering of the applied heat, forms a metallurgical bond with such surfaces. The result is to create a seal and a bond between inner and outer peripheries of the inserted ring members and contacted tube surfaces as well as to provide a metallurgical bond between peak and valley portions of the several fin annuli and tube surfaces contacted thereby. With respect to the fin annuli and the tubes, therefore, an efficient uniform flow of heat energy is assured at the longitudinally extending joints represented at each fin 21. Further, the ends of the tubes are positively closed and sealed by the several inserted ring members with no opportunity of escape for contained fluids. In this connection, it will be noted that the arrangement positively segregates the several flowing fluids from one another. Moreover, if as a result of vibration or other operational stress leakage does occur around a ring member at a tube end, leakage will be to ambient surroundings with no opportunity afforded for a leaked fluid to mix with another fluid.

Fixtures 46, 47, 51 and 52 are installed on their respective tubes in any desired manner, as for example by brazing or welding. They may be brazed as a part of the above mentioned brazing operation. Thus, they may be positioned and held in place by a suitable fixture, with braze alloy in a foil form or the like positioning between a lower end of each fitting and a respective tube surface.

The generated heat of the brazing process might under some conditions and with respect to some materials have the effect of relaxing the tubes 10–13 so that they may tend to expand from the contracted condition in which they have been placed by the electromagnetic forming operation.

With this in mind, an assembled and electroformed heat exchanger may, prior to brazing, be wrapped by a band 62 which at its ends has upstanding ears 63 and 64 interconnected by an adjustable bolt means 65. The band 62 is made of a material selected to have a relatively low rate of expansion, with respect to the expansion of the material in the heat exchanger, in the temperature range at which brazing is accomplished. Accordingly, with the band 62 surrounding outer tube 13 and clamped relatively tightly thereto by adjustment of the bolt means 65, the tube assembly is held under compression during the brazing process in a manner to minimize its physical reaction to applied heat.

In the process of assembly of the heat exchanger, it has been described that a fin annulus is wrapped around a first tube and the wrapped tube then inserted into a second tube. The invention also has in view methods of assembly which may differ in detail from this, for example one in which first and second tubes are placed in telescoping relation and a preformed fin annulus then inserted between them. It is possible, also, that a fin annulus could be inserted into the second or outer tube, allowed to expand therein and be followed by insertion of the first or inner tube. Insofar as the claims which follow may seem to define one or another of these techniques, they will be understood to be comprehensive of all thereof.

The fin annuli have been described as being clad with a braze alloy on both sides thereof. It will be understood that in the case of fin annuli 17 and 19 it is important only that the braze alloy be on one side thereof, that is, the side of fin annulus 17 facing tube 11 and the side of fin annulus 19 facing tube 12.

The invention has been disclosed in connection with what may be termed a three-fluid heat exchanger. It will be evident that it is applicable also to a two-fluid heat exchanger in which case fin annulus 19, tube 13 and associated parts would be omitted. Similarly, of course, the disclosed method may be continued in repeated steps resulting in four or more concentric flow paths.

The electromagnetic forming coil has been described as comprised of opposing, complementary coil portions. It is of course possible and as a practical matter may be more convenient to make single continuously wound coils within which tubular assemblies and sub-assemblies are inserted.

The invention has been disclosed in a preferred form and in some described modifications in connection with a method of making an annular tube fin heat exchanger of specified construction. These and other modifications in both the method steps and involved structure obvious to a person skilled in the art are regarded as being within the intent and scope of the invention.

I claim:

1. A method of making a heat exchanger, including the steps of:

a. providing a tube made of a relatively rigid heat conductive metal and a compressible fin annulus comprising corrugated thin metal deformable material, b. inserting the compressible fin annulus in said tube and providing a central support therefor, said support rigidly backing said fin annulus, c. applying a radial compressive force to said fin annulus so that all parts thereof are in closely contacting compressive relation to the interior wall of said tube irrespective of irregularities in fin height, the application of compressive forces being accomplished by displacing the tube wall radially inwardly, d. the fin annulus reacting upon said central support and the tube wall deforming to conform to fin irregularities, e. prior to applying said radial compressive force inserting in at least one end of said tube a relatively incompressible closure member, f. said member having a cross sectional dimension to have a relatively loose fit in said tube and the tube wall in being radially inwardly displaced encountering between its ends relatively compressible means in the form of said fin annulus and at least at said one end thereof encountering the firm resistance of said closure member, g. a single contracting tube therefore closing tightly at least at said one end on an inserted closure member and between its ends engaging and applying a compressive pressure to said fin annulus, h. and metallurgically bonding together the parts so assembled.

2. A method according to claim 1, wherein:

a. prior to said step of metallurgically bonding, the recited steps of assembly are repeated in connection with a second tube and inserted fin annulus, b. a first mentioned contracted tube with contained fin annulus being surrounded by a second fin annulus and inserted in said second tube and a closure member being inserted in at least one end of said second tube and a compressive force being applied radially displacing inwardly said second tube to close tightly at least at one end on an inserted closure member and between its ends engaging and applying a compressive force to said second fin annulus, c. the said first mentioned tube providing a rigid central support for said second fin annulus.

3. A method according to claim 2, wherein:

a. closure members are inserted in both ends of both said first mentioned and second tubes, b. said closure members inserted in said first mentioned tube being apertured whereby a fluid may flow into said first mentioned tube at one end thereof and pass longitudinally through an annular space defined by said first mentioned tube and the central support therein occupied by the first mentioned fin annulus and out of said tube by way of the other end thereof, c. said second tube having apertures adjacent opposite ends thereof between inserted closure members therein whereby another fluid may enter said second tube near one end thereof, flow through the annular space defined between said tubes occupied by said second fin annulus and exit from said second tube near the opposite end thereof.

4. A method according to claim 3, wherein:

a. said first mentioned fin annulus and said second fin annulus are short in length in relation to the length of the tubes in which they are mounted, said fin annuli being installed in said tubes to be centered between the tube ends and provide with adjacent closure members collection chambers for the flowing fluids.

5. A method according to claim 3, wherein:

a. said fin annuli are formed to provide alternating peaks and valleys, b. the peaks and valleys of the said first mentioned fin annulus being in approximately touching contact respectively with an inner wall of said first mentioned tube and with said central support and the peaks and valleys of said second fin annulus being in approximately touching contact respectively with the inner wall surface of said second tube and with the outer wall surface of said first mentioned tube, at least peak portions of the said first mentioned fin annulus and valley portions of said second fin annulus being clad with a braze alloy whereby following said metallurgical bonding step peak portions of said first mentioned fin annulus and valley portions of said second fin annulus are united respectively with inner and outer wall portions of said first mentioned tube.

6. A method according to claim 4, wherein:

a. prior to said step of metallurgical bonding the recited steps of assembly are repeated in connection with a third tube having an installed third fin annulus and inserted closure members, b. said third tube being short in relation to said second tube and said third tube being apertured for flow of a third fluid through an annular space occupied by said third annulus.

7. A method according to claim 6, wherein:

a. the tube displacement is carried out in successive steps in each of which a partly completed and finally a completed assembly is placed in an electromagnetic coil having a length fully to receive a tube to be contracted, b. and said coil is energized, end and intermediate portions of said tube responding independently of one another to applied electromagnetic forces.

8. A method according to claim 7, wherein:

a. the step of metallurgical bonding including heating of a completed assembly, b. and prior to said bonding step a completed assembly is wrapped by a band made of a material having a lesser coefficient of expansion under heat than the material of which said tubes are made, c. said band being tightened an amount sufficient to obviate a relaxing of said tubes from their inwardly displaced condition as a function of said heating step.

* * * * *